US010267503B2

(12) United States Patent
Yu et al.

(10) Patent No.: US 10,267,503 B2
(45) Date of Patent: Apr. 23, 2019

(54) LIGHT APPARATUS

(71) Applicant: XIAMEN ECO LIGHTING CO. LTD., Xiamen (CN)

(72) Inventors: Qiqing Yu, Xiamen (CN); Qiongqiao Zhang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/599,432

(22) Filed: May 18, 2017

(65) Prior Publication Data

US 2018/0245755 A1 Aug. 30, 2018

(30) Foreign Application Priority Data

Feb. 28, 2017 (CN) ..... 2017 1 01137503

(51) Int. Cl.

| | |
|---|---|
| ***F21S 8/02*** | (2006.01) |
| ***F21V 23/00*** | (2015.01) |
| ***F21V 21/04*** | (2006.01) |
| *F21V 17/12* | (2006.01) |
| *F21V 3/02* | (2006.01) |
| *F21V 17/10* | (2006.01) |
| *F21V 7/22* | (2018.01) |
| *F21V 23/06* | (2006.01) |
| *F21Y 115/10* | (2016.01) |
| *F21Y 103/33* | (2016.01) |

(52) U.S. Cl.

CPC ..... *F21V 23/007* (2013.01); *F21V 21/047* (2013.01); *F21Y 2103/33* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,960,973 | B1 * | 2/2015 | Kathawate | H01R 4/70 174/92 |
| 9,062,866 | B1 * | 6/2015 | Christ | F21V 29/004 |
| 2014/0307441 | A1 * | 10/2014 | Wu | F21V 31/005 362/267 |
| 2015/0233537 | A1 * | 8/2015 | Athalye | F21S 8/026 362/147 |
| 2017/0307143 | A1 * | 10/2017 | Shah | F21K 9/237 |

* cited by examiner

*Primary Examiner* — Ashok Patel

(74) *Attorney, Agent, or Firm* — Chun-Ming Shih

(57) ABSTRACT

A light apparatus for being installed in an accommodating space of the wall includes following components. A light source circuit generates light for lighting when being energized. A main shell is set with an exposed portion and an embedded portion, at least a portion of the exposed portion is located out of the wall, and the embedded portion is located in the accommodating space. A cup body is set with a bottom part and a side surrounded part, the side surrounded part is connected to the embedded portion of the main shell, the light source circuit is located on the bottom part. A driving circuit box for placing the driving circuit, wherein the driving circuit generates current for driving the light source circuit after power supply, and at least a connecting structure is used to sequentially fix the cup body, the main shell and the driving circuit box together.

19 Claims, 4 Drawing Sheets

LIGHT APPARATUS

TECHNICAL FIELD

The present disclosure relates to a light apparatus, and more particularly to an LED light apparatus.

BACKGROUND OF INVENTION

A light apparatus has always been an important item for human life. With the advancement of electronic technology, people always hope the light apparatus may be cheaper, more efficient or more powerful. In addition, the designs for the different environments, the ease of installation, and how to avoid the wet environment damaging the light apparatus, etc., above all are the important factors may be considered for a new light apparatus design.

For example, almost every family has a similar need of installing a light apparatus on a ceiling. Even there may be several light apparatuses embedded in the ceiling in a house. Due to the large number and need differences for use, any small innovation may bring great improvement to the whole light apparatus. For example, if you increase the convenience of installation, adjust the elasticity for different installation parameters, block moisture, or reduce the cost of assembly, all are very valuable innovative works.

Therefore, how to innovate based on the seemingly matured technology, itself is a valuable challenge.

SUMMARY OF THE INVENTION

The first embodiment of the instant disclosure provides a light apparatus being installed in accommodating space of the wall. For example, such a light apparatus may be designed as a tube light to be mounted in a ceiling hole. Of course, besides the ceiling, in other walls, or the accommodating space formed by a position is protruded from the wall but is fixed in a box, which is attached to wall, also belongs to the concept of coverage. For non-fixed but movable light apparatus, as long as they have a storage space to set the embedded portion of under mentioned main shell, through the equivalent principle, also be listed as the light apparatus, which has an equivalent part set in the accommodating space of the wall.

The light apparatus provides with a light source circuit that generates light for illumination when energized. Embodiments of such a light source circuit include a light source circuit consisted of an LED (Light Emitting Diode) core and the corresponding circuit. Of course, other light sources suitable for installation in this embodiment may also be used in accordance with different design apparatus.

The light apparatus provides with a main shell. The main shell provides with an exposed portion and an embedded portion. The main shell may be integrated, for example, a unitary element made by plastic processing technology. At least a portion of the exposed portion is located outside the wall, the embedded part located within the accommodating space. One side of the exposed portion may be leaned on the wall, and the other side located away from the wall.

The light apparatus provides with a cup body. The cup body provides with a body bottom part and a body side surrounded part. The body side surrounded part abuts against the embedded portion of the main shell. The light source circuit is located on one side of the body bottom part. The body bottom part and the body side surrounded part mentioned here may be formed by a solid surface with small holes, wherein the ratio of the solid part is more than 90%, or a mesh structure having multiple holes or other structures.

The light apparatus provides with a driving circuit box for placing the driving circuit generating a current for driving the light source circuit after power supplied.

The light apparatus further is set with at least a connection structure for fixing the cup body, the main shell and the driving circuit box in sequence. In one embodiment, the cup body is sandwiched by the cup body and the driving circuit box in a fixed position through the connection structure. In another embodiment, the fixed sequence may be the main shell, the cup body, and then followed by the driving circuit box.

The connection structure may formed by the main shell, the cup body or the protruding structure of the driving circuit box, the groove hole, and/or the matching screw.

In one embodiment, the connection structure includes a hollow cylinder and a screw on the driving circuit box. The hollow cylinder may be integrated with the driving circuit box. The hollow cylinder is set with threads corresponding to the screws. The screws penetrate from a hole in the body bottom into the hollow cylinder of the driving circuit box through a hole of the embedded portion of the main shell, to fix the cup body, the main shell in and driving circuit box in sequence.

In one embodiment, the lighting source circuit includes a substrate. The substrate may be made of a metal material, such as aluminum. The substrate provides with a hole corresponding to the screw, the screw passing through the hole into the hole of the cup body bottom, and then the screw passes through the hole of the embedded portion of the main shell into the hollow cylinder of the driving circuit box. By means of such a connection, the substrate, the cup body, the main shell of the light source circuit is sequentially fixed together with the driving circuit box.

In one embodiment, the driving circuit box and the bottom of the embedded portion of the main shell may be set with a corresponding first alignment structure. In addition, the embedded portion of the main shell and the cup body may be set with a corresponding second alignment structure. By means of the first alignment structure and the second alignment structure, it is possible to secure the driving circuit box and the main shell fixed at a predetermined angle when assembled with the driving circuit box. This significantly helps maintain the structural stability of the overall light apparatus, reduce the difficulty of assembly, and reduce the flaws in the assembly.

The first alignment structure or the second alignment structure referred to herein may be passed through a groove, a track, a hole to match a corresponding projection, a ridge, or the like, and the elements of the first alignment structure or the second alignment structure may be partially or completely integrated with the material of the main shell, the cup body, or the driving circuit box, or may be formed by additional elements.

The bottom of the embedded portion of the main shell may be substantially solid or have a hole having an area accounted for more than 30%, 50% or 70% of the bottom total area. In one embodiment, the bottom portion of the cup body passed directly through the hole in the bottom of the embedded portion of the main shell to face the driving circuit box. And an edge portion of the bottom portion of the cup body abuts against an edge portion of the main shell. Through this kind of design, the cooling efficiency may be further increased. And the driving circuit may be more easily connected to the light source apparatus of the cup body.

When the light apparatus is a tube light, the driving circuit box may provide with two extension arms for mounting two fixed springs, respectively, and the fixed springs used for fixing the light apparatus to the accommodating space of the wall.

In addition, the extension arm may provide with an adjustment structure for adjusting the width of the two springs to accommodate the different accommodating spaces. For example, the extension arm may provide with a track for mounting a metal sheet that may be moved in the track. The metal sheet may be fixed to the specified position on the track by screws. The metal sheet further connected to the spring to adjust the width of the spring extension. With such a design, the same light apparatus may be installed in the accommodating spaces of the tube lights with different aperture, further increasing the flexibility of the light apparatus in use and installation. For example, if there are multiple different sizes of holes in a house, you may still buy the same light apparatus. In addition, the same light apparatus design may be made for meeting the different standard of different tube lights sizes in different countries, thereby significantly reducing manufacturing costs and increasing inventory flexibility and efficiency.

In one embodiment, the light source circuit may include a substrate, multiple LED cores, and a connection terminal, the driving circuit having two electrodes connected to the connection terminal through the bottom of the cup body. Wherein the multiple LED cores may be disposed on the substrate in a geometrical shape similar to the bottom of the cup body.

For example, if the bottom of the cup body is a circular, the multiple LED cores may be arranged in one or more turns around the center of the bottom of the cup body. If the cup body is polygonal, multiple LED cores may also be arranged in one or more turns around the polygons at the bottom of the cup body.

In one embodiment, the light apparatus may also include a light diffusion board. For example, the light diffusion board may be a plastic board atomized on the surface or glass board for softening the light to uniform lighting effect. The exposed portion of the main shell is defined as exposed hole. The light diffusion board may cover the exposed hole and be fixedly connected to the main shell. For example, there is a stepped structure located in the area near the exposed hole for disposing the edge portion of the light diffusion board. In one design, the light diffusion board may simultaneously abut against the upper edge of the cup body to lock the cup body by the light diffusion board and the embedded portion of the main shell to maintain fixed.

In other words, under such a design, the connecting place of the light diffusion board and the main shell may be glued and fixed. When the light diffusion board and the main shell fixed, the cup body is fixed at the same time, and there is no need for additional gluing on the cup body, which may further reduce the cost of assembly.

In addition, the glue is waterproofed and/or heat dissipated to further providing protection to the light source circuit.

For the shape of the cup body, the body side surrounded portion may be a straight line, multi-section straight line, curve, multi-section curve or partially straight line and partially curve design. The shape of the cup body may be designed in response to the light source configuration position of the light source circuit, so that multiple light sources may radiate through the cup body, and more towards the outside of the wall to increase the lighting efficiency and reduce heat accumulation in the light apparatus.

In one embodiment, the circumference of upper edge of the cup body is longer than the bottom of the cup body. For example, the upper edge of the cup body, that is, the part closer to the wall, the circumference of that is larger than the bottom of the cup body, that is, the part far away from the wall. If the upper edge of the cup body and the bottom is circular, the diameter of the upper edge is larger than the bottom.

In addition, in one embodiment, the body side surrounded portion is a curve. The curvature of the curve near the bottom is lower than the curve near the upper edge of the cup body.

In one embodiment, the material of the cup body is harder than the main shell. This design may reduce the overall cost and ensure the stability of the structure. Because the solid characteristics of the cup body may ensure the light source apparatus is properly protected, further increase the safety of light apparatus. Thus, the main shell may be made of plastic, and the cup body may be made of metal, alloy or plastic with higher hardness or other materials.

In addition, if the cup body is made of metal or metal-containing material, or other materials easily conducted, the cooling problem of the light apparatus may be further solved.

In one embodiment, the surface of the cup body is coated with a white coating to enhance the reflective effect. In addition, the inside of the cup body may also be made of white material, so that the surface of the cup may not need to be coated. In addition to white paint, other colors of paint or reflective coating may also be coated in the inside surface of the cup body to enhance the reflective effect.

In one embodiment, the light apparatus further includes an external connection terminal, the external connection terminal connected to the driving circuit, and the other side connected to an external power source. The external connection terminal may include a lamp head for electrical connecting to the bulb holder directly.

In addition, in one embodiment, the side of the main shell provides with one or more step sections for positioning the cup body and the light diffusion cover.

In addition, in one embodiment, the driving circuit box includes a third alignment structure for aligning the main shell with the driving circuit box to maintain a predetermined angle.

The light apparatus design of different combination would reduce costs, increase flexibility, increase safety and stability and/or reduce the complexity of assembly etc.

DETAILED DESCRIPTION

Please mutually refer to FIG. 1, FIG. 2, FIG. 3, FIG. 4A and FIG. 4B. The concepts of the embodiments of the present invention may be described with reference to these drawings.

Figure 1:
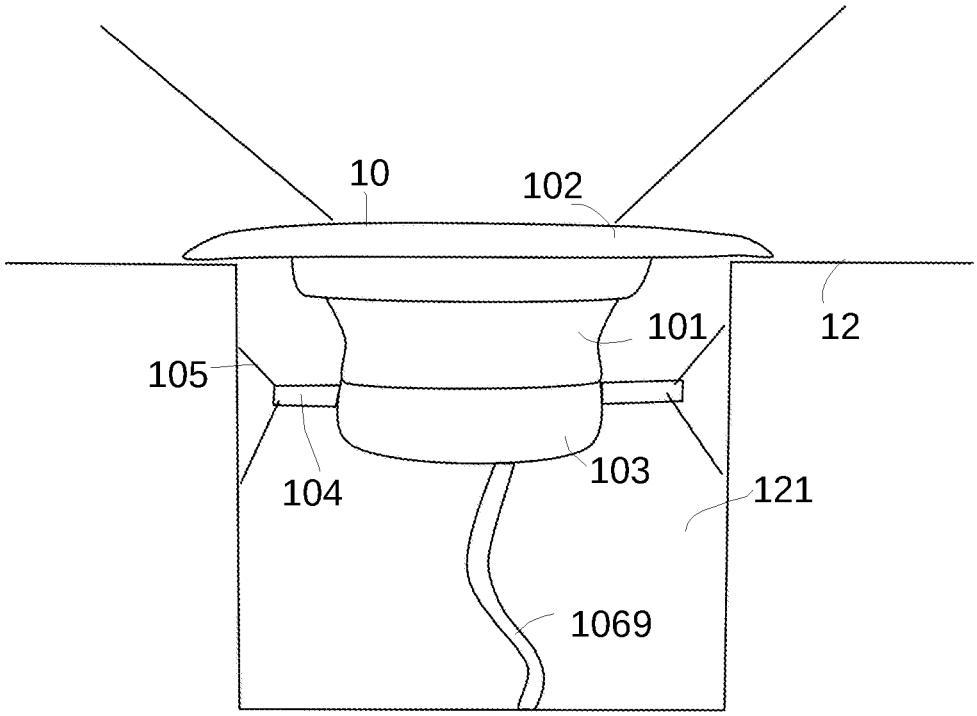
FIG. 1 illustrates a schematic diagram of a light apparatus amounted on the wall according to the embodiment of the present disclosure.

First, please refer to FIG. 1. The example of light apparatus 10 in FIG. 1 is a tube light being installed in the accommodating space 121 of the wall 12. Of course, in addition to the ceiling, in other walls, or the accommodating space formed by a position protruded from the wall but fixed in a box attached to wall, also belong to the concept of coverage. For non-fixed but movable light apparatus, as long as they have a storage space to set the embedded portion of under mentioned main shell, through the equivalent principle, may also be listed as the light apparatus having an equivalent part set in the accommodating space of the wall.

The light apparatus provides with a main shell. The main shell provides with an exposed portion 102 and an embedded portion 101. The exposed portion 102 mentioned here mainly refers to a portion where the main shell exposed to the wall, and the embedded portion 101 mainly refers to a portion located in the accommodating space 121. The main shell may be integrated, for example, a unitary element made by plastic processing technology. Of course, in other embodiments, the main shell is also assembled by two or more elements. At least a portion of the exposed portion 102 is located outside the wall, the embedded part 101 located within the accommodating space. One side of the exposed portion 102 is leaned on the wall 12, and the other side located away from the wall 12.

The light apparatus 10 may be set with two extension arms 104. The extension arm 104 may further be set with a fixed spring 105 for securing the light apparatus in the accommodating space 121 of the wall 12.

The light apparatus 10 provides with a driving circuit box 103 for placing the driving circuit, the driving circuit generating a current for driving the light source circuit after power supplied. The driving circuit is connected to an external power source through a connecting line or a corresponding terminal 1069.

Figure 2:
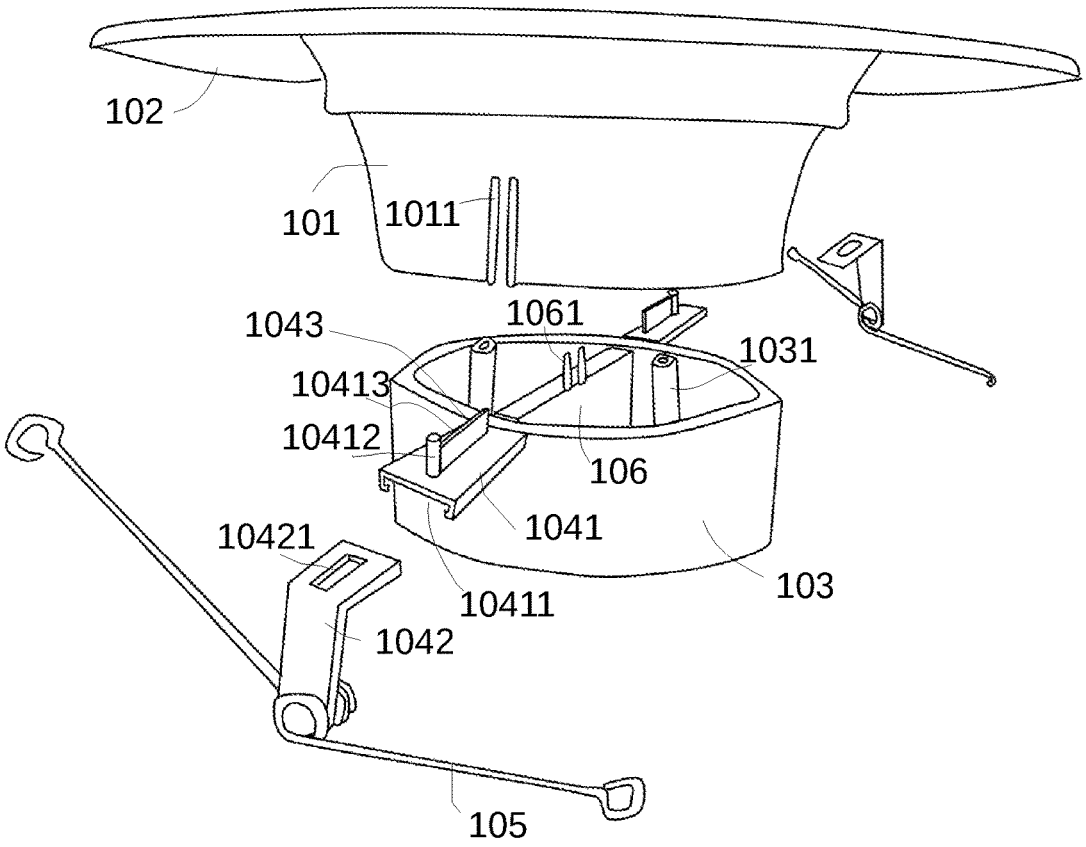
FIG. 2 illustrates a schematic stereogram of a partial element according to the embodiment of the present invention.
Figure 3:
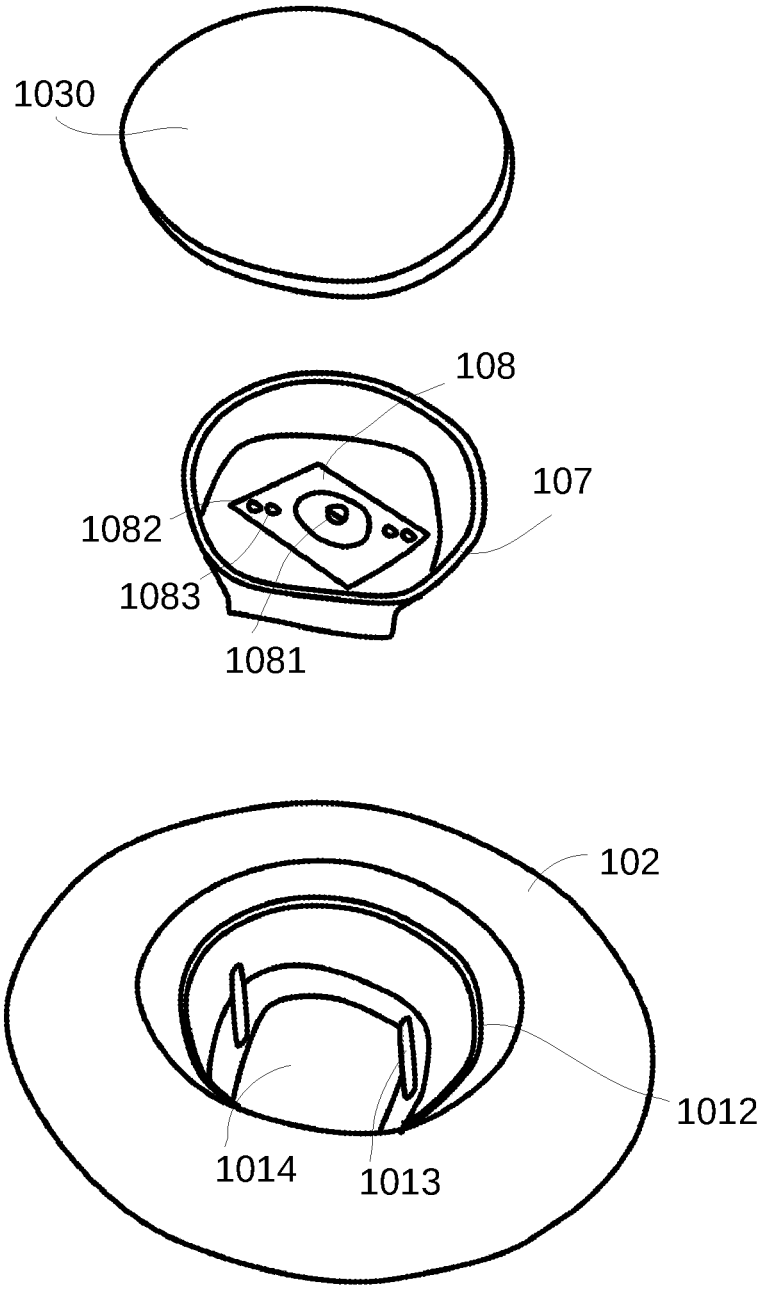
FIG. 3 illustrates a schematic stereogram of a partial element according to the embodiment of the present invention.
Figure 4A:
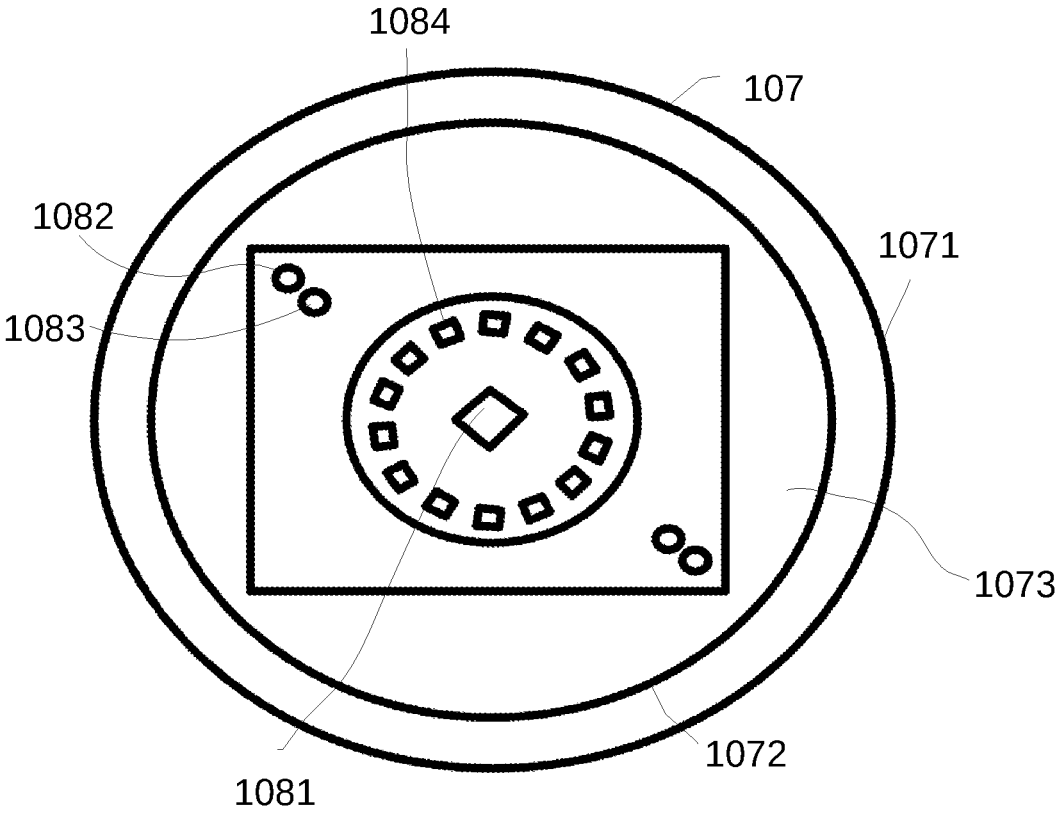
FIG. 4A illustrates a top view of a partial element according to the embodiment of the present invention.
Figure 4B:
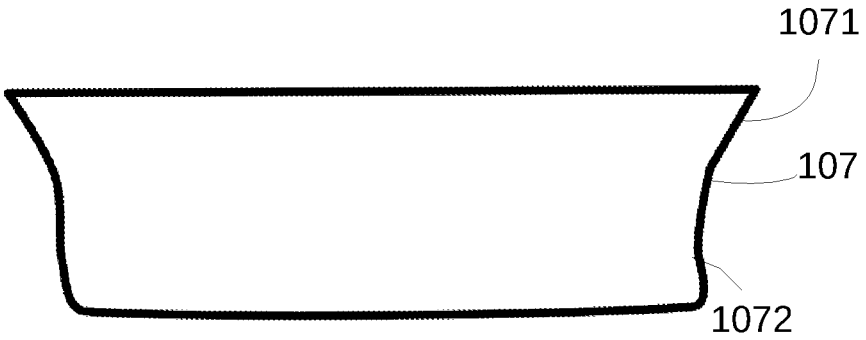
FIG. 4B illustrates a side view of a partial element of FIG. 4A according to the embodiment of the present invention.

Please mutually refer to FIG. 2, FIG. 3, FIG. 4A and FIG. 4B. FIG. 2 illustrates a schematic stereogram of a partial element according to the embodiment of the present invention. FIG. 3 illustrates a schematic stereogram of a partial element according to the embodiment of the present invention. FIG. 4A illustrates a top view of a partial element according to the embodiment of the present invention. FIG. 4B illustrates a side view of a partial element according to the embodiment of the present invention.

From these figures you may further see that the light apparatus 10 provides with a light source circuit 108 that generates light for illumination when energized. Embodiments of the light source circuit include a light source circuit consisted of an LED (Light Emitting Diode) core 1084 and the corresponding circuit. Of course, other light sources suitable for installation in this embodiment may also be used in accordance with different design apparatuses.

The light apparatus provides with a cup body 107. The cup body 107 provides with a body bottom part 1073 and a body side surrounded part 1072. The body side surrounded part 1072 abuts against the embedded portion 101 of the main shell. The light source circuit 108 is located on one side of the body bottom part 1073. The body bottom part 1073 and the body side surrounded part 1072 mentioned here may be formed by a solid surface with small holes, wherein the ratio of the solid part is more than 90%, or a mesh structure having multiple holes or other structures.

The light apparatus 10 may be set with at least a connection structure for fixing the cup body 107, the main shell and the driving circuit box 103 in sequence. In one embodiment, the embedded portion 101 of the cup body is sandwiched by the cup body 107 and the driving circuit box 103 in a fixed position through the connection structure. In another embodiment, the fixed sequence may be the main shell, the cup body 107, and then followed by the driving circuit box 103.

The connection structure may be formed by the main shell, the cup body 107 or the protruding structure of the driving circuit box 103, the groove hole, and/or the matching screw.

For example, it may be seen in FIG. 3 and FIG. 4A that there are two pairs of apertures 1082, 1083 on the substrate of the light source circuit 108, wherein a pair of holes 1082 inserted into the screw. The screws pass through the holes in the substrate of the light source circuit 108 and then through the corresponding holes of the cup body 107 and then pass through the corresponding holes of the insert 101 of the main shell and then insert into the hollow cylinder 1031 corresponding to the threads. The hollow cylinder 1031 may be set on the driving circuit box 103. The hollow cylinder 1031 may be integrated with the driving circuit box 103.

The driving circuit box 103 may be set with a drive circuit 106. The current generated by the driving circuit 106 may be connected to the light source circuit 108 through the two terminals 1061 and the holes in the back of the cup body 107.

In one embodiment, the lighting source circuit 108 includes a substrate. The substrate may be made of a metal material, such as aluminum. The substrate provides with a hole 1082 corresponding to the screw, the screw passing through the hole 1082 into the hole of the cup body bottom 107. And then the screw passes through the hole of the embedded portion 101 of the main shell into the hollow cylinder 1031 of the driving circuit box 103. By means of such a connection, the substrate, the cup body 107, the main shell of the light source circuit is sequentially fixed together with the driving circuit box 103. In the embodiment mentioned here, the number of the hollow cylinder is two, but it may be another number. The hollow cylinder may further strengthen the structural stability of the entire light apparatus 10.

In one embodiment, the driving circuit box 103 and the bottom of the embedded portion 101 of the main shell may be set with a corresponding first alignment structure. The alignment structure may be made by multiple different approaches. For example, in FIG. 2, the groove 1011 of the main shell and the projection corresponding to the drive circuit box 103 may be used to form the corresponding alignment structure. In addition, the embedded portion 101 of the main shell and the cup body 107 may be set with a corresponding second alignment structure. The alignment structure also may be made by multiple different approaches. For example, in FIG. 3, the cylinder 1013 on the main shell may be inserted into the corresponding hole 1083 at the bottom of the cup body 107 to form a corresponding alignment structure. It may be noted that the number of such alignment structures may be adjusted according to different design requirements. By means of the first alignment structure and the second alignment structure, it is possible to secure the driving circuit box 103 and the main shell fixed at a predetermined angle when assembled with the driving circuit box 103. This will significantly help to maintain the structural stability of the overall light apparatus 10, reduce the difficulty of assembly, and reduce the flaws in the assembly.

The first alignment structure or the second alignment structure referred to herein may be passed through a groove, a track, a hole to match a corresponding projection, a ridge, or the like. And the elements of the first alignment structure or the second alignment structure may be partially or completely integrated with the material of the main shell, the cup body 107, or the driving circuit box 103, or may be formed by additional elements.

The bottom of the embedded portion 101 of the main shell may be substantially solid or have a hole having an area accounted for more than 30%, 50% or 70% of the bottom total area. For example, in FIG. 3, at the bottom of the main shell, there is a schematic view of hole 1014. In one embodiment, the bottom portion 1073 of the cup body 107 passed directly through the hole 1014 in the bottom of the embedded portion 101 of the main shell to face the driving circuit box 103. And an edge portion of the bottom portion 1073 of the cup body 107 abuts against an edge portion of the main shell. Through this kind of design, the cooling efficiency may be further increased. And the driving circuit 106 may be more easily connected to the light source apparatus 108 of the cup body 107.

When the light apparatus 10 is a tube light, the driving circuit box 103 may provide with two extension arms 1041 for mounting two fixed springs 105, respectively, and the fixed springs 105 used for fixing the light apparatus to the accommodating space of the wall.

In addition, the extension arm 1041 may provide with an adjustment structure for adjusting the width of the two springs 105 to accommodate the different accommodating spaces. For example, the extension arm 1041 may provide with a track 10411 for mounting a metal sheet 10412 that may be moved in the track. The metal sheet 10412 may be fixed to the specified position on the track 10411 by screws. The metal sheet 10412 further connected to the spring 105 to adjust the width of the spring 105 extension. With such a design, the same light apparatus may be installed in the accommodating spaces of the tube lights with different aperture, further increasing the flexibility of the light apparatus in use and installation. For example, if there are multiple different sizes of holes in a house, you may still buy the same light apparatus. In addition, the same light apparatus design may be made for meeting the different standard of different tube lights sizes in different countries, thereby significantly reducing manufacturing costs and increasing inventory flexibility and efficiency.

In one embodiment, the light source circuit may include a substrate, multiple LED cores 1084, and a connection terminal 1081. The driving circuit 106 has two electrodes 1061 connected to the connection terminal 1081 through the bottom of the cup body 107. Multiple LED cores 1084 may be disposed on the substrate in a geometrical shape similar to the bottom of the cup body.

For example, if the bottom of the cup body 107 is a circular, multiple LED cores 1084 may be arranged in one or more turns around the center of the bottom of the cup body 107. If the cup body 107 is polygonal, multiple LED cores 1084 may also be arranged in one or more turns around the polygons at the bottom of the cup body 107.

In one embodiment, the light apparatus 10 may also include a light diffusion board 103. For example, the light diffusion board 1030 may be a plastic board atomized on the surface or glass board for softening the light to uniform lighting effect.

The exposed portion 102 of the main shell is defined as exposed hole. The light diffusion board 1030 may cover the exposed hole and be fixedly connected to the main shell. For example, there is a stepped structure 1012 located in the area near the exposed portion 102 for disposing the edge portion of the light diffusion board. In one design, the light diffusion board 1030 may be simultaneously connected to the upper edge 1071 of the cup body 107 to lock the cup body by the light diffusion board 1030 and the embedded portion 101 of the main shell to remain fixed.

In other words, under such a design, the connecting place of the light diffusion board 1030 and the main shell may be glued and fixed. When the light diffusion board 1030 and the main shell fixed, the cup body 107 is fixed at the same time, and there is no need for additional gluing on the cup body 107 to further reduce the cost of assembly.

In addition, the glue is waterproofed and/or heat dissipated to further providing protection to the light source circuit.

For the shape of the cup body, the body side surrounded portion 1072 may be a straight line, multi-section straight line, curve, multi-section curve or partially straight line and partially curve design. The shape of the cup body 107 may be designed in response to the light source configuration position of the light source circuit 108, so that multiple light sources may radiate through the cup body 107, and more towards the outside of the wall to increase the lighting efficiency and reduce heat accumulation in the light apparatus.

In one embodiment, the circumference of the upper edge of the cup body 107 is longer than the bottom 1073 of the cup body. For example, the upper edge 1071 of the cup body, that is, the part closer to the wall, the circumference of that is larger than the bottom 1073 of the cup body, that is, the part far away from the wall. If the upper edge 1071 of the cup body 107 and the bottom 1073 is circular, the diameter of the upper edge 1071 is larger than the bottom 1073.

In addition, in one embodiment, the body side surrounded portion 1072 is a curve. The curvature of the curve near the bottom 1073 is lower than the curve near the upper edge 1071 of the cup body.

In one embodiment, the material of the cup body 107 is harder than the main shell. This design may reduce the overall cost and ensure the stability of the structure. Because the solid characteristics of the cup body 107 may ensure the light source apparatus is properly protected, further increase the safety of light apparatus. Thus, the main shell may be made of plastic, and the cup body 107 may be made of metal, alloy or plastic with higher hardness or other materials.

In addition, if the cup body 107 is made of metal or metal-containing material, or other materials easily conducted, the cooling problem of the light apparatus may be further solved.

In one embodiment, the surface of the cup body 107 is coated with a white coating to enhance the reflective effect. In addition, the inside of the cup body 107 may also be made of white material, so that the surface of the cup may not need to be coated. In addition to white paint, other colors of paint or reflective coating may also be coated in the inside surface of the cup body 107 to enhance the reflective effect.

In one embodiment, the light apparatus further includes an external connection terminal, the external connection terminal connected to the driving circuit 106, and the other side connected to an external power source. The external connection terminal may include a lamp head for electrically connecting to the bulb holder directly.

In addition, in one embodiment, the side of the main shell provides with one or more step sections for positioning the cup body and the light diffusion cover.

In addition, in one embodiment, the driving circuit box includes a third alignment structure for aligning the main shell with the driving circuit box to maintain a predetermined angle.

Designing the light apparatus by different combination may reduce costs, increase flexibility, increase safety and stability and/or reduce the complexity of assembly etc.

While the present invention has been described with respect to the embodiments described above, those skilled in the art makes appropriate substitutions or modifications in accordance with the foregoing description, including the elimination of one element or the addition of elements, also may fall within the scope of the present invention.

The invention claimed is:

1. A light apparatus for being installed in an accommodating space of a wall comprising:

a light source, wherein the light source generates light for lighting when the light source is energized;

a main shell, wherein the main shell has an exposed portion and an embedded portion, at least a portion of the exposed portion is located out of the wall, and the embedded portion is located in the accommodating space;

a cup body, wherein the cup body has a bottom part and a side surrounded part, a peripheral area of the bottom part being connected to an end opening of the side surrounding part, the side surrounded part is connected to the embedded portion of the main shell, and the light source is located on the bottom part;

a driving circuit box for placing a driving circuit, wherein the driving circuit generates current of the light source after power supply; and at least one connecting structure, wherein the at least one connecting structure sequentially fixes the cup body, the main shell and the driving circuit together, wherein the connection structure comprises a hollow cylinder and a screw on the driving circuit box, wherein the hollow cylinder is set with threads corresponding to the screws, wherein the screws penetrates from a hole in the bottom part into the hollow cylinder of the driving circuit box through the hole of the embedded portion of the main shell, and sequentially fixes the cup body, the main shell and the driving circuit box.

2. The light apparatus of claim 1, further comprising a third alignment structure, wherein the driving circuit box has the third alignment structure for aligning the main shell with the driving circuit box to maintain the predetermined angle.

3. The light apparatus of claim 1, wherein the lighting source circuit comprises a substrate, the substrate is set with a corresponding hole of the screw, the screw passes through the hole of the screw corresponding to the substrate into the hole of the bottom part of the cup body, and passes through the hole of the embedded portion of the main shell into the hollow cylinder of the driving circuit box to sequentially fix the substrate, the cup body, the main shell and the driving circuit box.

4. The light apparatus of claim 1, further comprising a first alignment structure and a second alignment structure, wherein the driving circuit box and a bottom of the embedded portion of the main shell are set with the corresponding first alignment structure, wherein the embedded portion of the main shell and the cup body are set with the corresponding second alignment structure, through the first alignment structure and the second alignment structure make sure the driving circuit box and the main shell are fixed at a predetermined angle when assembled with the driving circuit box.

5. The light apparatus of claim 1, wherein the bottom of the embedded portion of the main shell is set with a hole.

6. The light apparatus of claim 1, further comprising two extension arms and two fixed springs, wherein the driving circuit box is set with the two extension arms for mounting the two fixed springs, and the two fixed springs are used for fixing the light apparatus to the accommodating space of the wall.

7. The light apparatus of claim 6, wherein the extension arms are set with adjustable structures for adjusting width of the two fixed springs to accommodate the different accommodating spaces.

8. The light apparatus of claim 1, wherein the light source comprises a substrate, a plurality of LED (Light Emitting Diodes) cores, and a connection terminal, wherein the driving circuit has two electrodes to be connected to the connection terminal through the bottom of the cup body.

9. The light apparatus of claim 8, wherein the plurality of LED (Light Emitting Diodes) cores are disposed on the substrate in a geometrical shape being similar to the bottom of the cup body.

10. The light apparatus of claim 1, further comprising a light diffusion board, wherein the exposed portion of the main shell is defined as an exposed hole, wherein the light diffusion board covers the exposed hole and is fixedly connected to the main shell, and the light diffusion board is connected to an upper edge of the cup body to make the cup body keep fixed by fixing the light diffusion board and the embedded portion of the main shell.

11. The light apparatus of claim 10, wherein the light diffusion board is fixed with the main shell through glue.

12. The light apparatus of claim 10, wherein a circumference of the upper edge of the cup body is longer than the bottom of the cup body.

13. The light apparatus of claim 1, wherein the side surrounded part of the cup body is a curve, and a curvature of the curve near the bottom part of the cup body is lower than the curve near an upper edge of the cup body.

14. The light apparatus of claim 1, wherein material of the cup body is harder than the main shell.

15. The light apparatus of claim 1, wherein the material of the cup body comprises metal.

16. The light apparatus of claim 1, wherein a surface of the cup body is coated with a white coating to enhance a reflective effect.

17. The light apparatus of claim 1, further comprising an external connection terminal, wherein one side of the external connection terminal is connected to the driving circuit, and the other side of the external connection terminal is connected to external power source.

18. The light apparatus of claim 17, wherein the external connection terminal has a structure of a lamp head for directly entering to a bulb holder to realize an electrical connecting.

19. The light apparatus of claim 1, further comprising a light diffusion cover, wherein a side of the main shell is set with one or more step sections for positioning the cup body and the light diffusion cover.

* * * * *